US006696406B2

(12) United States Patent
Merkle et al.

(10) Patent No.: US 6,696,406 B2
(45) Date of Patent: Feb. 24, 2004

(54) FLUORESCENT WHITENING AGENT FORMULATION FOR DETERGENTS

(75) Inventors: Gerhard Merkle, Freiburg (DE); Jürgen Kaschig, Freiburg (DE); Josef Zelger, Riehen (CH); Serge Schroeder, Rosenau (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/239,136

(22) PCT Filed: Mar. 15, 2001

(86) PCT No.: PCT/EP01/02984

§ 371 (c)(1),
(2), (4) Date: Sep. 19, 2002

(87) PCT Pub. No.: WO01/70924

PCT Pub. Date: Sep. 27, 2001

(65) Prior Publication Data

US 2003/0119700 A1 Jun. 26, 2003

(30) Foreign Application Priority Data

Mar. 23, 2000 (EP) ..... 00810250

(51) Int. Cl.[7] ..... C11D 3/00; C11D 7/02; D06L 3/00

(52) U.S. Cl. ..... 510/518; 510/513

(58) Field of Search ..... 510/513, 518

(56) References Cited

U.S. PATENT DOCUMENTS 6,099,589 A 8/2000 Sowle et al. ..... 8/137

FOREIGN PATENT DOCUMENTS

| | | |
|---|---|---|
| DE | 2808927 | 9/1979 |
| DE | 19859575 | 7/1999 |
| EP | 0368383 | 5/1990 |
| EP | 0900783 | 3/1999 |
| GB | 2076011 | 11/1981 |
| WO | 96/30486 | 10/1996 |

OTHER PUBLICATIONS

Derwent Abstract 66463B/37 for DE 2808927 (1979).
Chem. Abstract 86:57144e for JP 76129403 (1977).
Derwent Abstract 1976–15867X [09] for JP 51005308 (1976).

*Primary Examiner*—Yogendra N. Gupta
*Assistant Examiner*—John M Petruncio
(74) *Attorney, Agent, or Firm*—Kevin T. Mansfield

(57) ABSTRACT

A liquid fluorescent whitening agent formulation comprising: a) a compound of formula (1), in which $R_1$ represents hydrogen, 1–5 C-alkyl, 1–5 C-alkoxy or halogen, M represents hydrogen, an alkaline- or alkaline earth-metal, or ammonium; b) a polyhydroxy compound; c) 5 to 95% water, whereby the ratio of the compound of Formula (1) to the polyhydroxy compound is between 10:90 and 90:10 parts by weight and the total weight of these compounds in the formulation is between 5 and 95% and, optionally, auxiliary stabilizing agents and the use thereof for the manufacture of detergents with improved shade consistency.

(1)

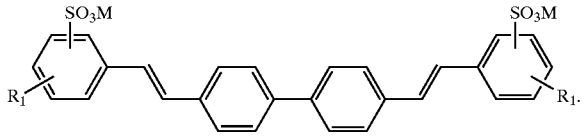

6 Claims, No Drawings

FLUORESCENT WHITENING AGENT FORMULATION FOR DETERGENTS

The present invention provides a formulation of a distyrylbiphenyl fluorescent whitening agent of the formula (1)

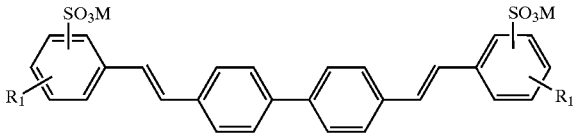

for imparting a particular shade consistency to detergent compositions.

As normally manufactured, compounds of Formula (1) have a yellowish tinge which, depending upon the method of manufacture, their formulation and conditions of storage, can impart an undesirable discolouration to the finished detergent.

Surprisingly, it has now been found that a specific formulation of compound (1) is able to overcome this disadvantage.

Accordingly, the present invention describes a liquid fluorescent whitening agent formulation comprising:

a) a compound of Formula (1) in which $R_1$ represents hydrogen, 1–5 C-alky, 1–5 C-alkoxy or halogen, M represents hydrogen, an alkaline- or alkaline earth-metal, or ammonium;

b) a polyhydroxy compound;

c) 5 to 95% water, whereby the ratio of the compound of Formula (1) to the polyhydroxy compound is between 10:90 and 90:10 parts by weight and the total weight of these compounds in the formulation is between 5 and 95% and, optionally, d) auxiliary stabilizing agents.

Preferably, the optical whitening agent is of the formula (2)

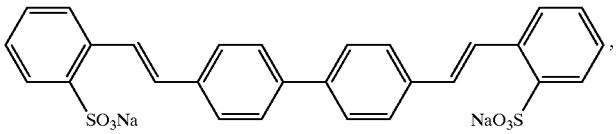

(3)

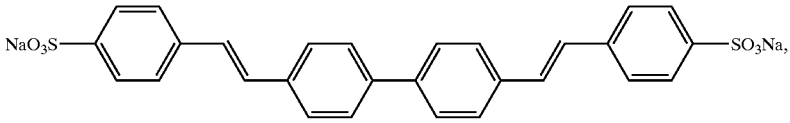

(4)

or

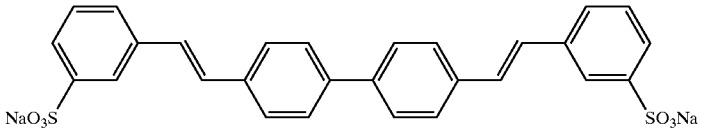

(5)

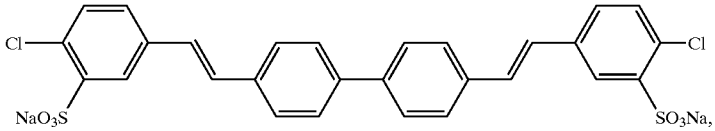

the compound of formula (2) being most preferred.

The polyhydroxy compound, component b) of the formulation is, preferably, a trio such as 1,2,6-hexanetriol, glycerine or an oligomer of glycerine such as a di-, tri- or polyglycerine, glycerine being most preferred.

A preferred formulation comprises a) 10 to 45% of the compound of formula (2);

b) 5 to 90% of glycerine;

c) 5 to 85% of water and auxiliary stabilizing agents, whereby a formulation comprising a) 20 to 40% of the compound of formula (2);

b) 10 to 80% of glycerine;

c) 5 to 70% of water and auxiliary stabilizing agents is particularly preferred.

When, in formula (1), $R_1$ represents 1–5 C-alkyl, these may be methyl, ethyl, n- or isopropyl, n-, sec-,or t-butyl, n-pentyl, iso-amyl or sec-amyl groups. When, in formula (1), $R_1$ represents 1–5 C-alkoxy, these may be methoxy, ethoxy, n- or isopropoxy, n-, sec-,or t-butoxy, n-pentyloxy, iso-amyloxy or sec-amyloxy groups. When, in formula (1), $R_1$ represents halogen, these may be fluorine, chlorine, bromine, or iodine, preferably chlorine.

Optional auxiliaries which may be present in the formulation of the present invention include stabilizers which are effective in adjusting the flow properties and phase stability of the formulation, preservatives, anti-foam agents, alkaline agents, fabric softeners, anti-redeposition agents, auxiliary builders such as polyacrylic acid and fragrances.

Examples of such stabilizers include, e.g., kaolin, an Mg/Al silicate, especially bentonite, montmorillonite, a zeolite or a highly dispersed silicic acid.

The formulation of the present invention may be produced by mixing the components a) to c) together with any optional auxiliaries, and homogenizing the mixture so obtained, preferably at an elevated temperature, e.g. at 40–100° C. Mixing is conveniently effected by a suitable stirring device.

The resulting formulation is either a clear solution or a flowable dispersion.

The formulation of the present invention is particularly suitable for incorporation into a detergent composition. Conveniently, the required amount of the formulation of the present invention is added to the detergent ingredients prior to the homogenization, granulation and drying procedures. Homogenizing may be performed either by a slurry-making process or by incorporation into an agglomeration device, such as a high shear mixer. Drying may be performed either in a spray drying tower or on a fluidized bed. The formulation of the present invention may also be suitable for incorporation into a dry detergent composition, conveniently by adding the required amount of the formulation to a dry detergent composition and then homogenizing the mixture so obtained. The formulation of the present invention may also be used, however, for the production of liquid detergents by adding the required amount of the formulation to a liquid detergent composition and then homogenizing the mixture so obtained.

Washing agents which can be used are the known mixtures of detergent substances, such as, for example, soap in the form of chips and powders, synthetic products, soluble salts of sulphonic acid half-esters of higher fatty alcohols, arylsulphonic acids. which are substituted by higher alkyl and/or polysubstituted by alkyl, carboxylic acid esters with alcohols of medium to higher molecular weight, fatty acid acylaminoalkyl- or aminoaryl-glycerol-sulphonates, phosphoric acid esters of fatty alcohols and the like. So-called "builders" which can be used are, for example, alkali metal polyphosphates and alkali metal polymeta-phosphates, alkali metal pyrophosphates, and also alkali metal silicates, alkali metal carbonates, alkali metal borates, nitrilotriacetic acid and ethylenediamine-tetraacetic acid. Furthermore, the washing agents can contain, for example: alkali metal salts of carboxymethylcellulose and other "soil redeposition inhibitors", alkali metal perborates, foam stabilisers, such as alkanolamides of higher fatty acids antistatic agents, superfatting skin protection agents, such as lanolin, enzymes, antimicrobial agents, perfumes and dyestuffs.

Typically, a phosphate built conventional detergent powder formulation may consist of:

| | |
|---|---|
| Anionic surfactants | 7–15% |
| Nonionic surfactants | 0–5% |
| Soap | 2–4% |
| Sodium tripolyphosphate | 25–50% |
| Silicates | 5–8% |
| Carboxymethyl cellulose | 0.5–1.5% |
| Phosphonates | 0.2–0.6% |
| Sodium sulphate | 15–25% |
| Fluorescent whitening agent | 0.05–0.5% |
| Water | 10%. |
| Fragrances | 0–1% |

The following Examples further illustrate the present invention. Parts and percentages shown therein are by weight unless otherwise stated.

EXAMPLE 1

A reaction vessel equipped with stirrer and heating bath is charged with 250 g of glycerine. The glycerine is heated to 60° C. and 232 g of a moist filter cake containing 54% of the compound of Formula (2) is added while stirring. The obtained slurry is cooled to room temperature and 19 g of water are added to yield a formulation containing:

25% of the compound of Formula (2)

50% of glycerine and

25% of water, as a slightly viscous, yellowish liquid.

0.6 g of this formulation was added to an aqueous suspension of a laundry detergent, containing 100 g of detergent ingredients. After stirring for 10 minutes a suspension was obtained which showed homogeneous fluorescence under UV radiation. After drying, a white detergent powder was obtained which remained white under various storage conditions (22° C., 40% rel. humidity, 30° C., 70% rel humidity)

EXAMPLES 2–4

By proceeding as described in Example 1, but employing appropriate quantities of moist 54% filter cake of compound (2), glycerine and water, the formulations described in the following Table 1 are obtained:

TABLE 1

| | Example 2 | Example 3 | Example 4 |
|---|---|---|---|
| Compound (2) | 26.0% | 30.0% | 30.0% |
| Glycerine | 51.9% | 15.0% | 30.0% |
| Water | 22.1% | 55.0% | 40.0% |
| Colour | yellowish | yellow | yellowish |
| Viscosity (visual) | liquid | slightly viscous | viscous |

EXAMPLES 5–8

By following the procedure described in Example 1, but performing the mixing process at room temperature (approximately 22° C.) instead of at 60° C., the formulations described in the following Table 2 are obtained:

TABLE 2

| | Example 5 | Example 6 | Example 7 | Example 8 |
|---|---|---|---|---|
| Compound (2) | 23.0% | 26.0% | 31.4% | 35.1% |
| Glycerine | 57.5% | 51.9% | 41.9% | 35.1% |
| Water | 19.5% | 22.1% | 26.7% | 29.8% |
| Colour | almost white | yellowish | yellowish | yellowish |
| Viscosity (visual) | viscous | viscous | slightly viscous | viscous |

EXAMPLE 9

The formulation of Example 8 is warmed at 60° C. for 2 hours and subsequently stored at room temperature, whereupon a viscous yellow liquid results.

EXAMPLES 10–24

To a glycerine/water solution, previously warmed to 60° C., appropriate quantities of the dried compound of formula (2) are added in portions with stirring. After stirring for a total time of 2.5 hours, the formulations are stored for 24 hours at room temperature and then milled with twice their weight of glass beads (diameter 2 mm) for 30 minutes at 500 rpm. Colour and viscosities of the formulations are visually assessed before and after milling. The results are summarized in the following Tables 3 to 5:

TABLE 3

| | Example 10 | Example 11 | Example 12 | Example 13 | Example 14 |
|---|---|---|---|---|---|
| Compound (2) | 15.0% | 15.0% | 20.0% | 20.0% | 20.0% |
| Glycerine | 28.0% | 43.0% | 18.0% | 33.0% | 48.0% |
| Water | 57.0% | 42.0% | 62.0% | 47.0% | 32.0% |
| Colour[1] | yellow | yellow | yellow | yellow | yellow |
| Viscosity[1] | fluid | fluid | fluid | fluid | fluid |

TABLE 3-continued

| | Example 10 | Example 11 | Example 12 | Example 13 | Example 14 |
|---|---|---|---|---|---|
| Colour[2] | white | yellowish | yellow | almost white | almost white |
| Viscosity[2] | fluid | fluid | fluid | fluid | fluid |

[1]before milling
[2]after milling

TABLE 4

| | Example 15 | Example 16 | Example 17 | Example 18 | Example 19 |
|---|---|---|---|---|---|
| Compound (2) | 20.0% | 25.0% | 25.0% | 25.0% | 30.0% |
| Glycerine | 63.0% | 23.0% | 38.0% | 53.0% | 28.0% |
| Water | 17.0% | 52.0% | 37.0% | 22.0% | 42.0% |
| Colour[1] | almost white | almost white | yellow | yellowish | yellow |
| Viscosity[1] | viscous | fluid | fluid | liquid | fluid |
| Colour[2] | white | pale yellow | almost white | almost white | white |
| Viscosity[2] | slightly viscous | liquid | fluid | fluid | liquid |

[1]before milling
[2]after milling

TABLE 5

| | Example 20 | Example 21 | Example 22 | Example 23 |
|---|---|---|---|---|
| Compound (2) | 30.0% | 35.0% | 35.0% | 35.0% |
| Glycerine | 43.0% | 18.0% | 33.0% | 48.0% |
| Water | 27.0% | 47.0% | 32.0% | 17.0% |
| Colour[1] | yellowish | almost white | yellowish | pale yellow |
| Viscosity[1] | liquid | slightly viscous | liquid | slightly viscous |
| Colour[2] | almost white | almost white | white | white |
| Viscosity[2] | liquid | viscous | liquid | slightly viscous |

[1]before milling
[2]after milling

EXAMPLES 24 and 25

21 g of the dry compound of formula (4) are added to 84 g of deionised water and the suspension milled with 210 g of glass beads (diameter 1 mm) in a wet-mill for 2 hours. After separating the glass beads, the appropriate quantity of glycerine is added and mixed at room temperature until a homogenous formulation is obtained. The results are summarized in the following Table 6:

TABLE 6

| | Example 24 | Example 25 |
|---|---|---|
| Compound (4) | 16.65% | 10.0% |
| Glycerine | 16.65% | 50.0% |
| Water | 66.7% | 40.0% |
| Colour | white | white |
| Viscosity (visual) | liquid | liquid |

No change in either colour or viscosity was observed after aging of the formulations.

What is claimed is:

1. A fluorescent whitening agent formulation comprising:

a) 20 to 40% of a compound of formula (2):

(2)

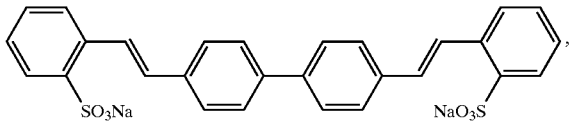

b) 10 to 80% of glycerine, c) 5 to 70% water, d) auxiliary stabilizing agents, or a fluorescent whitening agent formulation comprising:

a) a compound of formula:

(3)

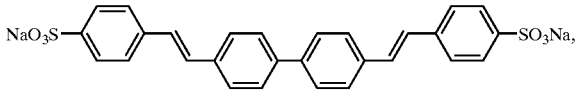

(4)

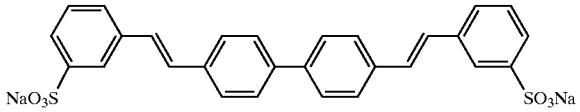

or (5)

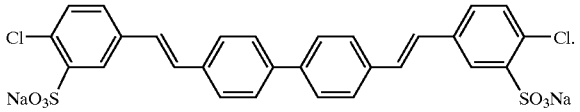

b) a polyhydroxy compound, c) 5 to 95% water, whereby the ratio of the compound of formula (3), (4) or (5) to the polyhydroxy compound is between 10:90 and 90:10 parts by weight and the total weight of these compounds in the formulation is between 5 and 95% and, optionally, d) auxiliary stabilizing agents.

2. A formulation according to claim 1 in which the polyhydroxy compound b) is a triol or an oligomer of glycerin.

3. A formulation according to claim 1 in which the compound of formula (1) is in a white crystal form.

4. A method for the manufacture of detergents with improved shade consistency which comprises incorporating therein a fluorescent whitening agent formulation according to claim 1.

5. A formulation according to claim 2 in which the triol is 1,2,6-hexanetriol or glycerin.

6. A formulation according to claim 2 in which the oligomer of glycerine is a di, tri- or polyglycerin.

* * * * *